US010266294B2

(12) United States Patent
Malin et al.

(10) Patent No.: US 10,266,294 B2
(45) Date of Patent: Apr. 23, 2019

(54) PALLET WRAPPING DEVICE

(71) Applicants: Ryan Malin, Orlando, FL (US); Rebecca Malin, Orlando, FL (US)

(72) Inventors: Ryan Malin, Orlando, FL (US); Rebecca Malin, Orlando, FL (US)

( * ) Notice: Subject to any disclaimer, the term of this patent is extended or adjusted under 35 U.S.C. 154(b) by 0 days.

(21) Appl. No.: 16/036,433

(22) Filed: Jul. 16, 2018

(65) Prior Publication Data

US 2019/0002149 A1 Jan. 3, 2019

Related U.S. Application Data

(63) Continuation of application No. 15/637,914, filed on Jun. 29, 2017, now Pat. No. 10,023,342.

(51) Int. Cl.

| | |
|---|---|
| ***B65B 11/58*** | (2006.01) |
| ***B65B 67/08*** | (2006.01) |
| ***B65H 23/06*** | (2006.01) |
| ***B65H 35/00*** | (2006.01) |
| *B44C 7/00* | (2006.01) |
| *B65B 67/00* | (2006.01) |
| *B65D 71/00* | (2006.01) |

(52) U.S. Cl.

CPC ..... *B65B 67/085* (2013.01); *B65B 11/585* (2013.01); *B65H 23/06* (2013.01); *B65H 35/002* (2013.01); *B44C 7/00* (2013.01); *B65B 67/00* (2013.01); *B65D 71/00* (2013.01); *B65H 2701/1944* (2013.01)

(58) Field of Classification Search

CPC ..... B65B 67/085; B65B 11/585; B65B 67/00

USPC .... 242/588, 588.1, 588.2, 423, 423.1, 423.2

See application file for complete search history.

(56) References Cited

U.S. PATENT DOCUMENTS 4,102,513 A * 7/1978 Guard ..... B65B 67/085 156/577
4,166,589 A * 9/1979 Hoover ..... B65B 67/085 156/577
4,477,037 A * 10/1984 Goldstein ..... B65B 67/085 242/423.2
4,484,717 A * 11/1984 Goldstein ..... B65B 67/085 188/67
4,530,473 A * 7/1985 Parry ..... B65B 67/085 242/422.4
4,535,951 A * 8/1985 Riemenschneider, III ..... B65B 67/085 242/423.2

(Continued)

*Primary Examiner* — Michael R Mansen
*Assistant Examiner* — Mark K Buse
(74) *Attorney, Agent, or Firm* — Jason T. Daniel, Esq.; Daniel Law Offices, P.A.

(57) ABSTRACT

A pallet wrapping device includes an elongated shaft having a fixed handle along a first end, and a diameter for slidingly receiving the hollow central channel of a roll of stretch film. A stopper is positioned along the second end of the elongated shaft, and includes a dimension that is greater than the dimension of the central channel of the roll of stretch film. A sliding handle unit having a first handle segment, a second handle segment and a hollow interior channel is slidingly positioned along the elongated shaft, and functions as a guide for dispensing the stretch film. A ring shaped member having a high friction material along one surface is disposed between the handle segments, and each handle segment includes an outside dimension that is positionable within the central channel of the roll of stretch film.

12 Claims, 7 Drawing Sheets

(56) References Cited

U.S. PATENT DOCUMENTS

| | | | | | |
|---|---|---|---|---|---|
| 4,714,211 | A * | 12/1987 | Hwang | B65B 67/085 | 242/423.1 |
| 5,664,739 | A * | 9/1997 | Black | B65H 75/406 | 242/588.2 |
| 5,788,608 | A * | 8/1998 | Wilkinson | A63B 21/0724 | 482/51 |
| 5,927,635 | A * | 7/1999 | Black | B65H 75/406 | 242/395 |
| 6,739,542 | B1 * | 5/2004 | Prina | B65B 67/085 | 242/423.2 |
| 7,290,733 | B2 * | 11/2007 | Kamenstein | B65H 23/06 | 242/598.2 |
| 7,357,349 | B1 * | 4/2008 | Huang | B65B 67/085 | 242/405.3 |
| 7,401,449 | B2 * | 7/2008 | Watson | B65B 67/085 | 242/423 |
| 7,543,426 | B1 * | 6/2009 | Phero | B65B 67/085 | 156/574 |
| 8,622,332 | B2 * | 1/2014 | Bologna | B65B 67/085 | 242/422.4 |
| 9,284,085 | B2 * | 3/2016 | Pace | B65B 67/085 | |
| 9,598,196 | B2 * | 3/2017 | Choi | B65B 67/085 | |
| 10,023,342 | B1 * | 7/2018 | Malin | B65B 67/085 | |
| 2007/0151208 | A1 * | 7/2007 | Huang | B65B 67/085 | 53/390 |
| 2008/0072538 | A1 * | 3/2008 | Kohn | B65B 67/085 | 53/358 |
| 2008/0072543 | A1 * | 3/2008 | Watson | B65B 67/085 | 53/441 |
| 2014/0116004 | A1 * | 5/2014 | Pace | B65B 67/085 | 53/390 |

* cited by examiner

PALLET WRAPPING DEVICE

CROSS-REFERENCE TO RELATED APPLICATIONS

This application claims the benefit of U.S. application Ser. No. 15/637,914 filed on Jun. 29, 2017, the contents of which are incorporated herein by reference.

TECHNICAL FIELD

The present invention relates generally to wrapping devices for pallets and other items, and more particularly to a hand operated pallet wrapping device.

BACKGROUND

The statements in this section merely provide background information related to the present disclosure and may not constitute prior art.

The shipment of pallet loads of goods constitutes a substantial part of commercial traffic. Frequently, the pallet loads are formed from a number of different sized and shaped articles that do not stack in a stable configuration, thereby requiring some form of tensioning wrap to be utilized.

To this end, there are a number of commercially available pallet wrapping machines which can function in an automated or semi-automated fashion to securely wrap palletized materials. However, such machines are typically designed and built to wrap extremely high volumes of palletized materials having a uniform shape and size. To this end, and owing to their high cost, the use of such machines has typically been limited to product manufacturers who ship extremely high volumes of identical materials, wherein each pallet is loaded and wrapped uniformly.

For these reasons, the most common means for wrapping palletized materials is to do so manually. As will be known to those of skill in the art, the most common type of pallet wrapping material is plastic stretch film, which is typically provided in a roll, and has an elongated cardboard (or other light material) tube that extends a few inches from the top and bottom ends to aid a user in manually wrapping a pallet of goods. In this regard, the user typically begins at one corner of the pallet and must literally crawl around the base of the pallet in order to ensure the film is secured thereon. Once the corners have been secured, the user will circle the pallet several times while incrementally raising the level of the stretch film.

Unfortunately, this process suffers from several drawbacks. For example, owing to the shortened nature of the cardboard handle, the height of the pallet is typically limited to the height the user can reach. As such, pallets are rarely taller than 72 inches, which means that valuable space within tractor trailers (typically over 12 feet in height) goes unused. Additionally, owing to the lightweight construction of the handles, it is difficult for the user to apply sufficient pressure onto the stretch material, as doing so often bends or breaks the handle making it unusable. Finally, because it is difficult for the user to easily access the bottom of the pallet, this portion often does not receive adequate wrapping, which can cause the entire pallet to become unstable during transport.

Although there are several known devices for facilitating manual pallet wrapping, such devices are typically designed to work with a single type or brand of stretch film, and/or require specialized tools or knowledge to change rolls or utilize the device. Such drawbacks limit the commercial success of these devices.

Accordingly, it would be beneficial to provide a pallet wrapping device that can be utilized with any type or size of stretch film material, that does not require specialized knowledge or tools to utilize, and that can eliminate the drawbacks described above.

SUMMARY OF THE INVENTION

The present invention is directed to a device for facilitating manual wrapping of palletized materials with stretch film. One embodiment of the present invention can include an elongated shaft having a fixed handle along a first end, and a diameter that is suitable for slidingly receiving the hollow central channel of a roll of stretch film. A stopper can be positioned along the second end of the elongated shaft, and can include a dimension that is greater than that of the central channel. A sliding handle unit having a first handle segment, a second handle segment and a hollow interior channel is slidingly positioned along the elongated shaft, and can function as a guide for dispensing the stretch film.

In another embodiment, the sliding handle unit can include a ring shaped member having a high friction material along one surface. Each of the handle segments can include an outside dimension that is positionable within the central channel of the roll of stretch film, so as to function as a tensioning unit.

In yet another embodiment, a mechanical tensioning unit can be disposed along the elongated shaft. The tensioning unit can include a first end, a second end, and a plurality of deformable wires that are suspended therebetween. The force required to twist the first and second ends can be adjustable.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1:
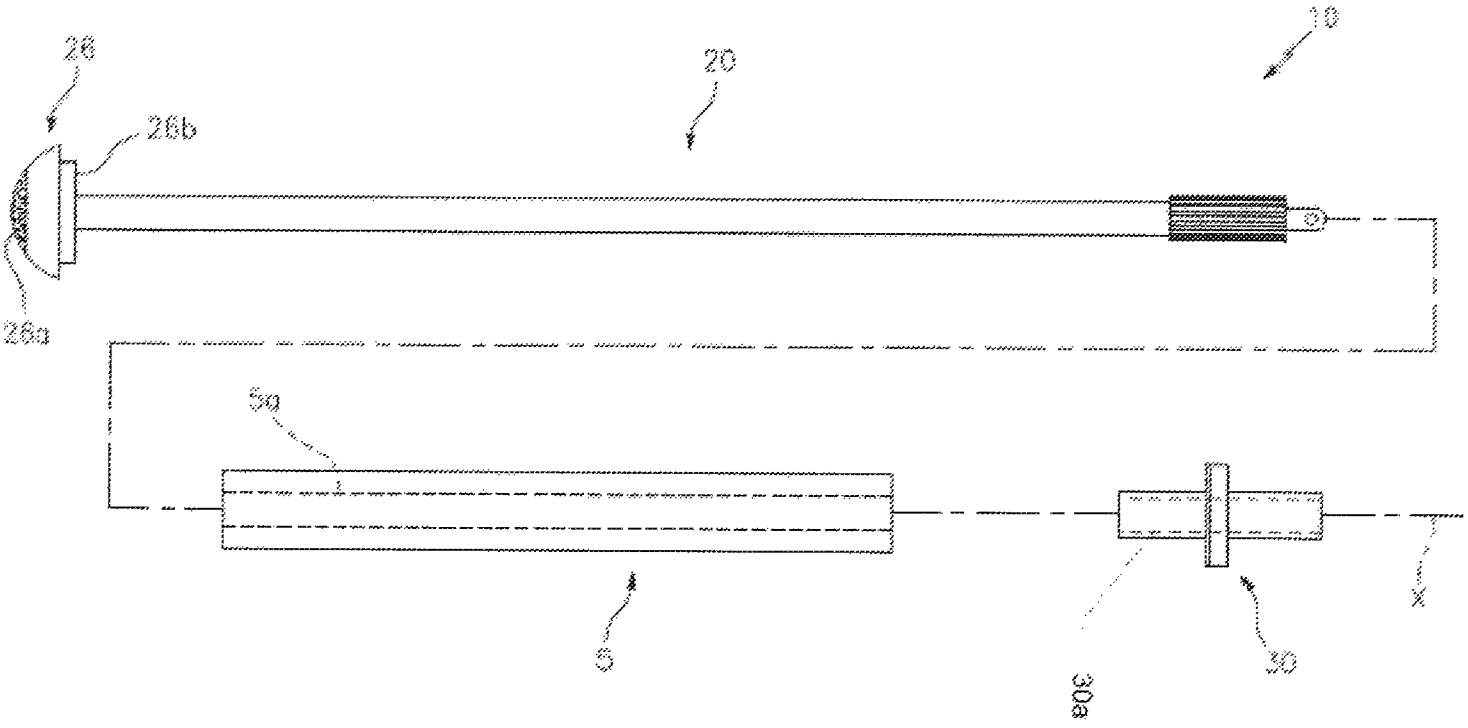
FIG. 1 is an exploded parts view of one embodiment of a pallet wrapping device that is useful for understanding the inventive concepts disclosed herein.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

In each of the drawings, identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 1.

As described herein, the term "removably secured" and derivatives thereof shall be used to describe a situation wherein two or more objects are joined together in a non-permanent manner so as to allow the same objects to be repeatedly joined and separated. This can be accomplished through the use of any number of commercially available connectors such as opposing strips of hook and loop material (i.e. Velcro®), magnetic elements, and compression fittings such as male-female joints, hooks, snaps and buttons, for example.

As described herein, the term "pivotally connected" "rotatably secured" and derivatives thereof shall be used interchangeably to describe a situation wherein two identified objects are joined together in a manner that allows one or both of the objects to pivot, twist, and/or rotate about or in relation to the other object in one or both of a horizontal and vertical manner. Several nonlimiting examples of connectors for pivotally connecting objects together include traditional single hinge mechanisms, ball joint couplers, and/or swivel flanges, for example.

As described herein, the terms "stretch film" and "stretch wrap" can be used interchangeably to describe any type of wrapping material for use with palletized items. Such items typically comprise lengths of highly stretchable plastic film having elastic recovery property for keeping items tightly bound. The film typically includes a width of approximately 30 inches, and is most commonly wrapped around a hollow core channel 5*a* having an inside diameter of approximately 2-4 inches. Of course, any number of other shapes, sizes and/or materials such as shrink wrap, for example, are also contemplated and can be utilized with the device in the manner described below. Likewise, the device can be sized to accommodate any number of other dimensions without undue experimentation.

FIG. 1 is an exploded parts view of one embodiment of a pallet wrapping device 10 that is useful for understanding the inventive concepts disclosed herein. As shown, the device 10 can include, essentially, a shaft 20, and a sliding handle unit 30, for engaging a roll of stretch film 5. Although described below for use as a pallet wrapping device, those of skill in the art will recognize that the inventive concepts disclosed herein are not so limiting. To this end, the below described device can be utilized for any number of different uses and industries without limitation.

Figure 2A:
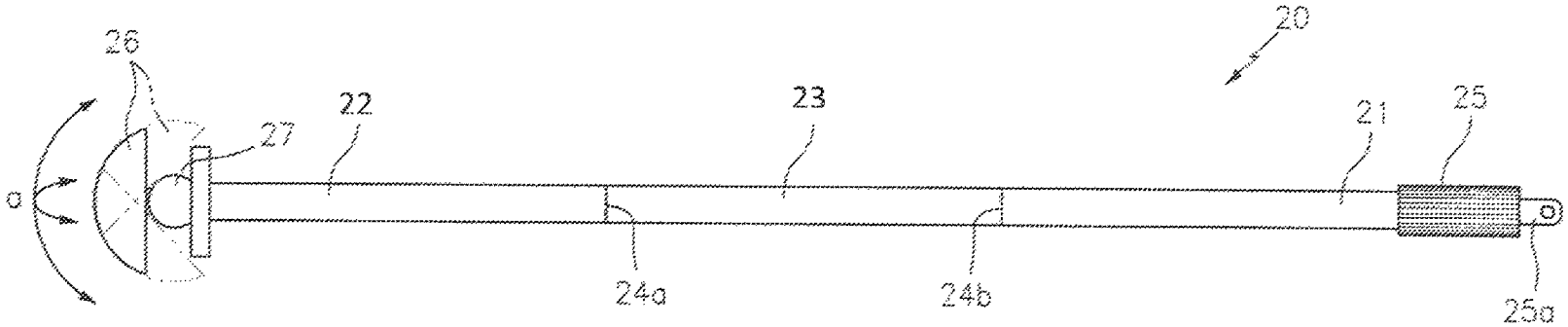
FIG. 2A is a side view of the elongated shaft of the pallet wrapping device, in accordance with one embodiment of the invention.

As shown best at FIG. 2A, the shaft 20 can include an elongated member having a first end 21, a second end 22 and a middle portion 23. In the preferred embodiment, the shaft can include a uniform shape and dimension for receiving the sliding handle unit 30 and any number of stretch film rolls 5. In various embodiments, the handle may be constructed as a single unit with a pre-defined length, or may be constructed modularly so as to be adjustable in length. In such embodiments, the handle can include any number of different connectors 24*a* and 24*b*, such as male/female compression fittings, for example, that can be joined together to form a plurality of shaft segments. Alternatively, the shaft can be constructed so as to allow various sections to extend and retract telescopically, in accordance with known manufacturing techniques. Such a feature being advantageous for allowing the device to be sold and shipped in smaller packaging in a disassembled configuration.

In either instance, the shaft 20 may be formed from any number of rigid materials that are, for example, relatively strong and stiff for their weight. Several nonlimiting examples include, but are not limited to various metals or metal alloys (e.g., aluminum, steel, titanium, or alloys thereof), plastic/polymers (e.g., high-density polyethylene (HDPE) or polyethylene terephthalate (PET)), and/or various composite materials (e.g., carbon fibers in a polymer matrix, fiberglass, etc.).

In one embodiment, a fixed handle 25 can be disposed along the first end of the shaft body 21. The handle can be constructed from any number of different materials such as rubber, for example, and can preferably include a shape and size having a minimum outward projection (e.g., less than 0.25 inches) from the shaft surface. As will be described below, the fixed handle 25 can provide a stable grip for allowing a user to apply tension onto the stretch film 5, when securing the same around a pallet. In various embodiments, an optional hook 25*a* or other such member can be provided along one end of the handle to facilitate hanging storage of the device.

In one embodiment, a stopper 26 can be removably secured along the second end of the shaft body 22. The stopper can include any number of different shapes and sizes, and can include an outside dimension that is greater than the outside dimension of the shaft body, and the stretch film channel 5*a*. Such a feature acting to prevent the same from sliding off the second end of the shaft body. In one embodiment, the stopper can include a generally curved outside facing surface that can be constructed from, or coated with a non-skid material 26*a*, so as to allow the stopper to slide across the (typically concrete) floor of a warehouse with minimum effort. Such a feature advantageously allows a user to wrap the bottom portions of a pallet with the stretch film from a standing position, thus eliminating the need for the user to kneel or bend. Likewise, an inside facing surface 26*b* can be constructed from or coated with a high friction material such as rubber, for example, to aid the user in applying a tensioning force onto the stretch film material.

In one embodiment, the stopper 26 can also be pivotally secured to the end of the shaft body 22 via a connector 27, such as a ball joint or other such device. Such a feature allows the orientation of the stopper 26 to pivot (see arrow a), with respect to the shaft 20, and advantageously allows a user to easily adjust the angle of the stretch film 5, when the stopper is sliding along the ground. Of course, other embodiments are contemplated wherein the stopper 26 can be constructed from the same material as the shaft body 20, so as to be formed together as a unitary and fixed-orientation element.

Figure 2B:
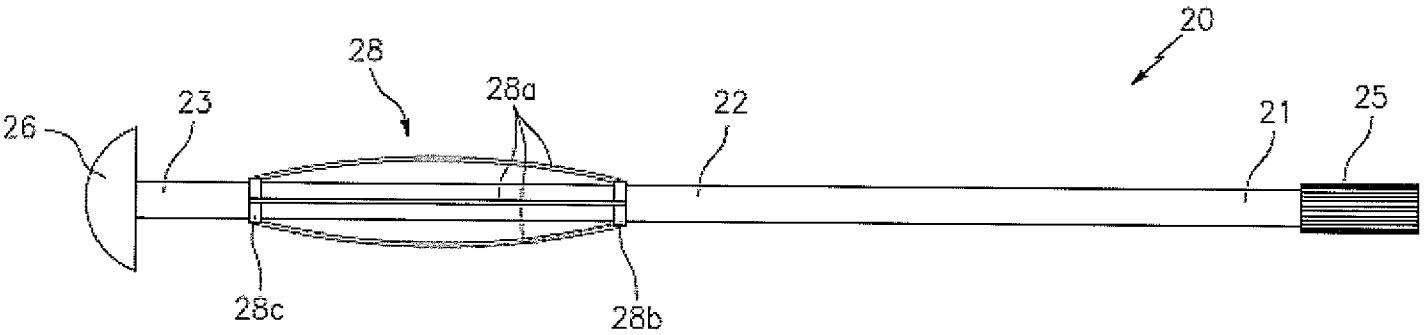
FIG. 2B is a side view of the elongated shaft of the pallet wrapping device, in accordance with another embodiment of the invention.

As shown in FIG. 2B, another embodiment of the device 10 can include a mechanical tensioning unit 28 that is disposed along the shaft 20. As shown, the mechanical tensioning unit can include a plurality of flexible wires 28*a* that are formed between two ends 28*b* and 28*c* which are rotatably secured onto the shaft 20. The wires 28*a* can each bow outward and can be deformable to provide a snug fit to the inside surface of the stretch film channel 5*a* (not illustrated). Such a feature ensures that the stretch film 5, the wires, and the ends all rotate together about the shaft 20 as a unit. Moreover, the force required to rotate one or both of the ends 28*b* and 28*c* can be adjustable, so as to provide the user with an integrated tension mechanism for dispensing the stretch film. One nonlimiting example of a mechanical tensioning unit which could be utilized with the device is described in U.S. Pat. No. 7,290,733, the contents of which are incorporated herein by reference.

Figure 3:
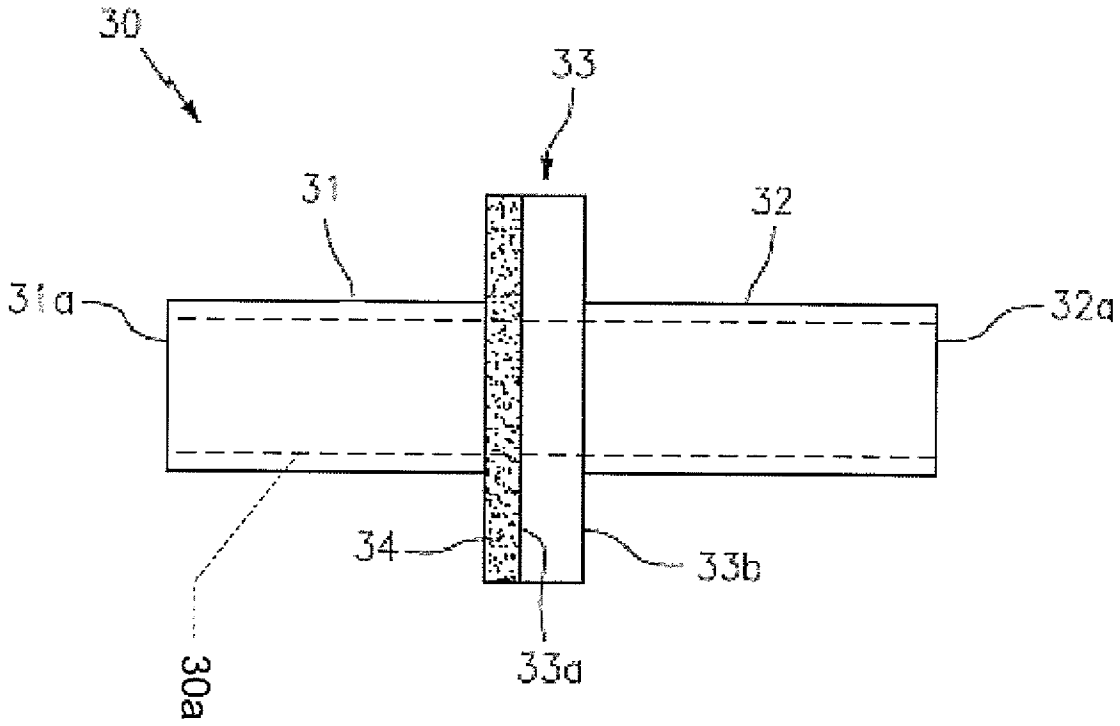
FIG. 3 is a side view of the handle unit of the pallet wrapping device, in accordance with one embodiment of the invention.

FIG. 3 illustrates one embodiment of the sliding handle unit 30. As shown, the handle can include a first handle segment 31, and a second handle segment 32 that are connected to form a hollow channel 30*a* having a first end 31*a* and a second end 32*a*. In the preferred embodiment, the hollow channel can include an inside dimension that is greater than the outside dimension of the elongated shaft 20, so as to allow the handle unit 30 to slide along the length of the shaft. Likewise, the handle segments can each include an outside dimension that is less than the inside dimension of the stretch film channel 5*a*, so as to allow each handle segment to be positioned within the film channel.

As shown, a generally ring-shaped member 33 can be positioned between the first and second handle segments. The ring shaped member can include a first surface 33*a* that is adjacent to the first handle segment 31 and a second surface 33*b* that is adjacent to the second handle segment 32. In the preferred embodiment, the ring-shaped member can include an outside dimension that is greater than the stretch film channel 5*a*, so as to prevent both handle segments from being simultaneously positioned within the film channel. Moreover, the first surface 33*a* can preferably be constructed from, or coated with a high friction material such as rubber, for example.

Figure 4:
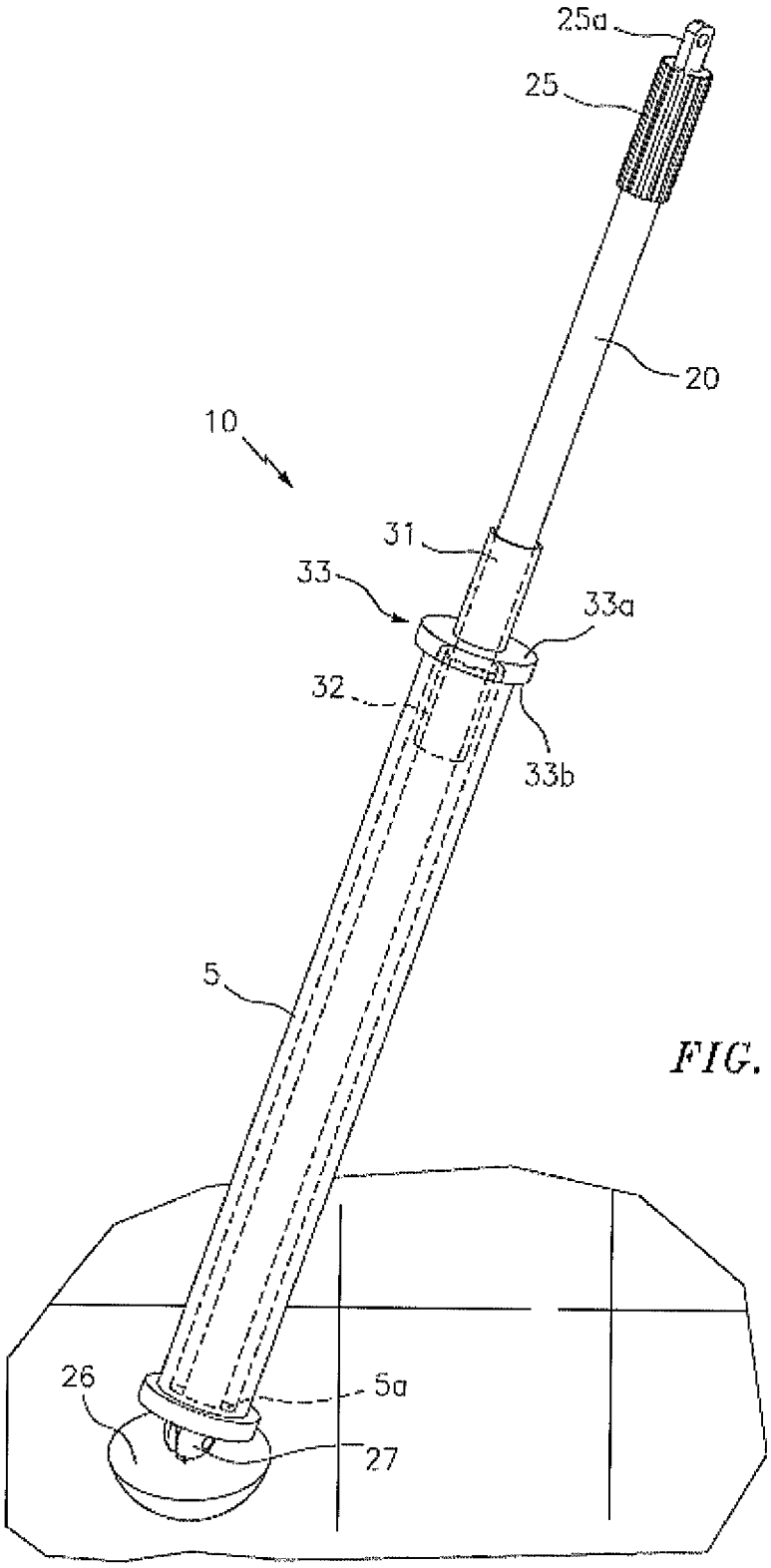
FIG. 4 is a perspective view of the pallet wrapping device, in accordance with one embodiment of the invention.
Figure 5:
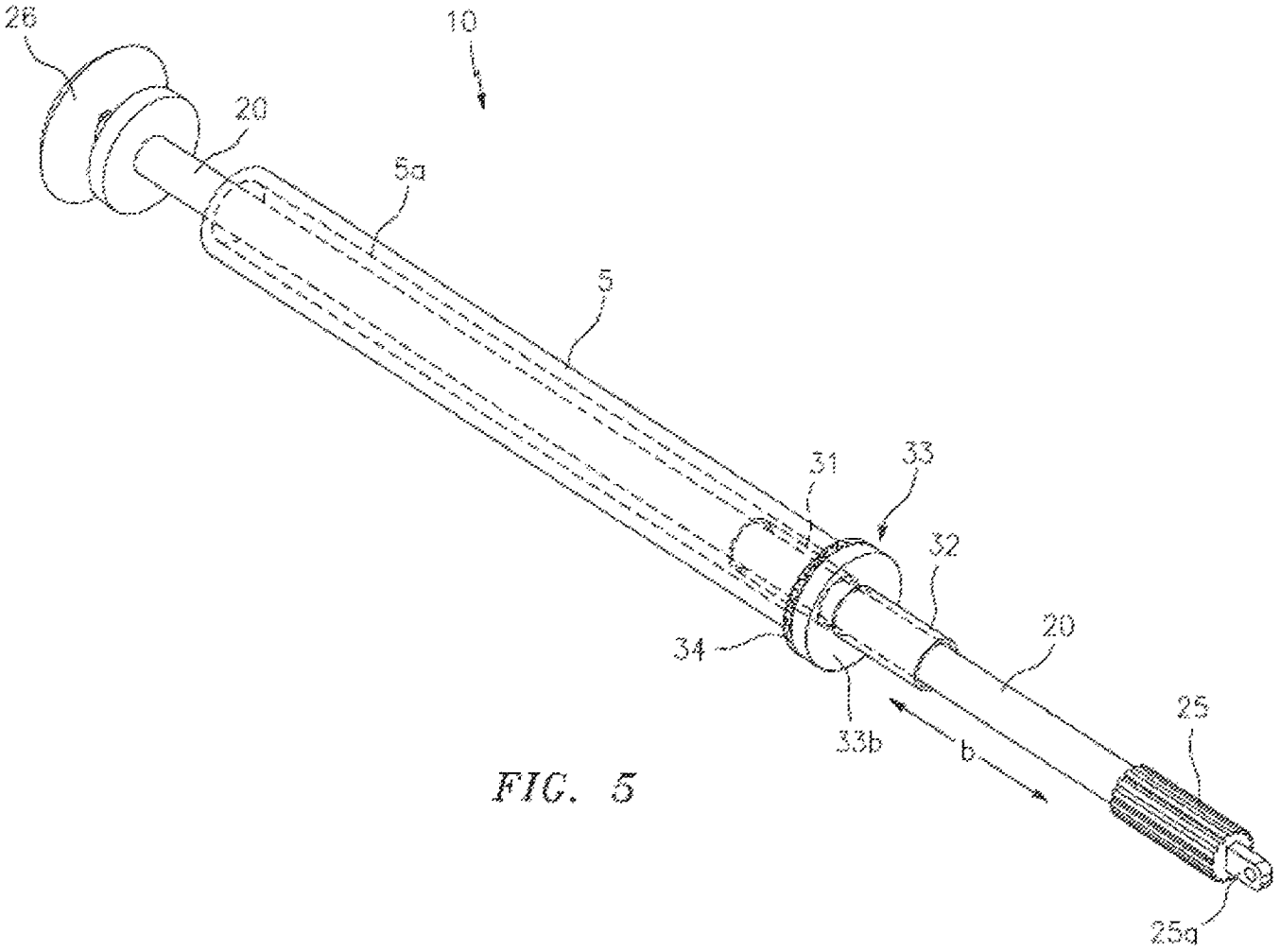
FIG. 5 is another perspective view of the pallet wrapping device, in accordance with one embodiment of the invention
Figure 6:
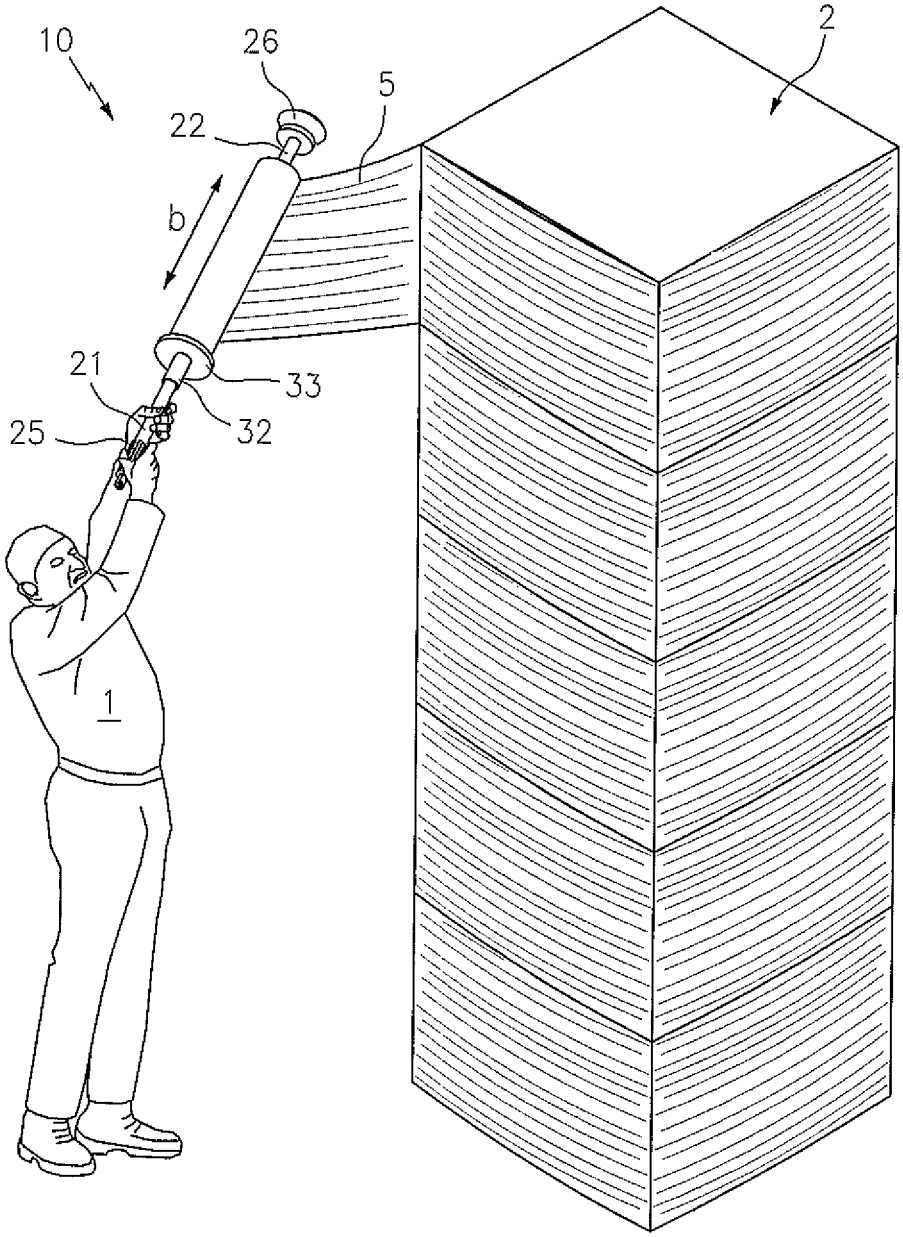
FIG. 6 is a perspective view of the pallet wrapping device in operation, in accordance with one embodiment of the invention.

FIGS. 4-6 illustrate one embodiment of the assembled device 10. As shown, the outside dimension of the shaft 20 can be constructed to be less than the hollow central channel 5*a* of an industry standard stretch film roll 5. As such, the stretch film roll can slide along the length of the shaft until making contact with the stopper 26. Next, the handle unit 30 can be slid along the length of the shaft 20 until one of the handle segments 31 or 32 is positioned within the film channel 5*a*.

During device operation, a user can grip the fixed handle 25 and one of the handle segments 31 or 32. To this end, when the second end 23 of the shaft is above the first end 21, a user 1 can manipulate the height of the stretch film 5 by sliding the handle unit 30 along the length of the shaft (see arrow b). Such a feature enables to user to wrap pallets 2 that are stacked above the head of the user. Moreover, when gripping the second handle segment, 32, the user can apply the high friction section 34 against the side of the stretch film. Such a feature effectively functions as a braking mechanism for allowing the user to selectively apply tension to the material being wrapped. This feature can be utilized in conjunction with, or in place of, the above described tensioning unit 28.

As described herein, one or more elements of the pallet wrapping device 10 can be secured together utilizing any number of known attachment means such as, for example, screws, glue, compression fittings and welds, among others. Moreover, although the above embodiments have been described as including separate individual elements, the inventive concepts disclosed herein are not so limiting. To this end, one of skill in the art will recognize that one or more individually identified elements may be formed together as one or more continuous elements, either through manufacturing processes, such as welding, casting, or molding, or through the use of a singular piece of material milled or machined with the aforementioned components forming identifiable sections thereof.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Likewise, the terms "consisting" shall be used to describe only those components identified. In each instance where a device comprises certain elements, it will inherently consist of each of those identified elements as well.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The invention claimed is:

1. A pallet wrapping device, comprising:

an elongated shaft having a first end, a second end, and a middle section, said elongated shaft being configured to slidingly receive a roll of stretch film having a hollow central channel;

a fixed handle that is disposed along the first end of the elongated shaft;

a stopper that is positioned along the second end of the elongated shaft, said stopper and fixed handle being oriented along a single plane, and said stopper being configured to engage a first end of the roll of stretch film; and a sliding handle unit comprising a pair of identically shaped handle segments that are arranged longitudinally, a ring shaped member having that is disposed between the pair of handle segments, and a hollow channel that extends between the pair of handle segments, wherein the stopper is pivotally secured to the second end of the elongated shaft, and the ring shaped member is configured to engage a second end of the roll of stretch film, and to dynamically adjust a position of the film along a length of the elongated shaft.

2. The device of claim 1, wherein the stopper is fixedly secured to the second end of the elongated shaft.

3. The device of claim 1, wherein each of the pair of handle segments are configured to be individually and separately positioned within the hollow central film channel of the roll of stretch film.

4. The device of claim 3, further comprising:

a first material that is disposed along one side of the ring shaped member, said first material being configured to increase a coefficient of friction between the ring shaped member and the roll of stretch film.

5. The device of claim 1, wherein the elongated shaft is constructed from a single piece of rigid material.

6. The device of claim 1, wherein the elongated shaft is constructed from a plurality of individual segments that are joined together along a longitudinal axis.

7. The device of claim 1, wherein the stopper includes a non-skid outer surface.

8. The device of claim 1, further comprising a mechanical tensioning unit that is secured along a longitudinal axis of the device, said mechanical tensioning unit including:

a first end that is rotatably secured onto the elongated shaft;

a second end that is rotatably secured onto the elongated shaft; and a plurality of deformable wires that are suspended between the first and second ends.

9. The device of claim 1, wherein the stopper includes a curved distal end.

10. The device of claim 9, further comprising:

a hanging hook that is positioned adjacent to the handle.

11. The device of claim 1, further comprising:

a first material that is positioned along a proximal end of the stopper, said first material being configured to increase a coefficient of friction between the stopper and the roll of stretch film; and said stopper including a curved distal end having a non-skid outer surface.

12. The device of claim 11, wherein the first material comprises rubber.

* * * * *